US005431511A

United States Patent [19]

Guy

[11] Patent Number: 5,431,511

[45] Date of Patent: Jul. 11, 1995

[54] TENSION LEG PLATFORM

[75] Inventor: Raymond G. Guy, Maidenhead, United Kingdom

[73] Assignee: Kvaerner Earl and Wright, United Kingdom

[21] Appl. No.: 156,730

[22] Filed: Nov. 24, 1993

[30] Foreign Application Priority Data

Nov. 26, 1992 [GB] United Kingdom ..... 9224776

[51] Int. Cl.[6] ..... E02D 29/09

[52] U.S. Cl. ..... 405/223.1; 405/205; 405/224; 114/264; 166/350; 166/367

[58] Field of Search ..... 405/195.1, 203, 205, 405/223.1, 224; 166/350, 359, 367; 175/7; 114/264

[56] References Cited

U.S. PATENT DOCUMENTS

| | | | |
|---|---|---|---|
| 3,981,357 | 9/1976 | Walker et al. | 166/359 |
| 4,048,945 | 9/1977 | Shrum | 405/223.1 X |
| 4,423,983 | 1/1984 | Dadiras et al. | 405/224 X |
| 4,448,266 | 5/1984 | Potts | 405/224 X |
| 4,466,487 | 8/1984 | Taylor | 166/367 X |
| 4,630,970 | 12/1986 | Gunderson et al. | 405/224 |
| 4,679,964 | 7/1987 | Blandford | 405/224 X |
| 4,768,455 | 9/1988 | Maxxson et al. | 405/224 X |
| 4,793,738 | 12/1988 | White et al. | 405/223.1 |
| 4,934,871 | 6/1990 | Kazokas | 405/224 |
| 5,220,961 | 6/1993 | Guesnon et al. | 166/367 |

FOREIGN PATENT DOCUMENTS

| | | |
|---|---|---|
| 2139677 | 11/1984 | United Kingdom . |
| 2230290 | 10/1990 | United Kingdom . |
| 2250767 | 6/1992 | United Kingdom . |

OTHER PUBLICATIONS

Offshore, Jul. 1988, p. 17, "Marine Engineering".

R. Koon and C. Langewis, *Joillet: The Project*, Offshore Technology Conference May 7–10, 1990, Paper No. 6359.

A. F. Hunter et al., *Designing the TLWP*, Offshore Technology Conference May 7–10, 1990, Paper No. 6360.

*Primary Examiner*—David H. Corbin
*Assistant Examiner*—John A. Ricci
*Attorney, Agent, or Firm*—Bacon & Thomas

[57] ABSTRACT

A tension leg platform for supporting an oil rig above a seabed includes a deck, a buoyant hull and a single tubular tether. The tether has a lower end penetrating into the seabed and an upper end that is secured to the hull to hold the hull down against its own buoyancy. The deck is secured to the hull and adapted to support an oil rig. Multiple casing strings extend through the tether from the deck to the seabed. Supplemental buoyancy, tanks can be provided between the hull and the tether or within the tether itself.

9 Claims, 2 Drawing Sheets

FIG 1
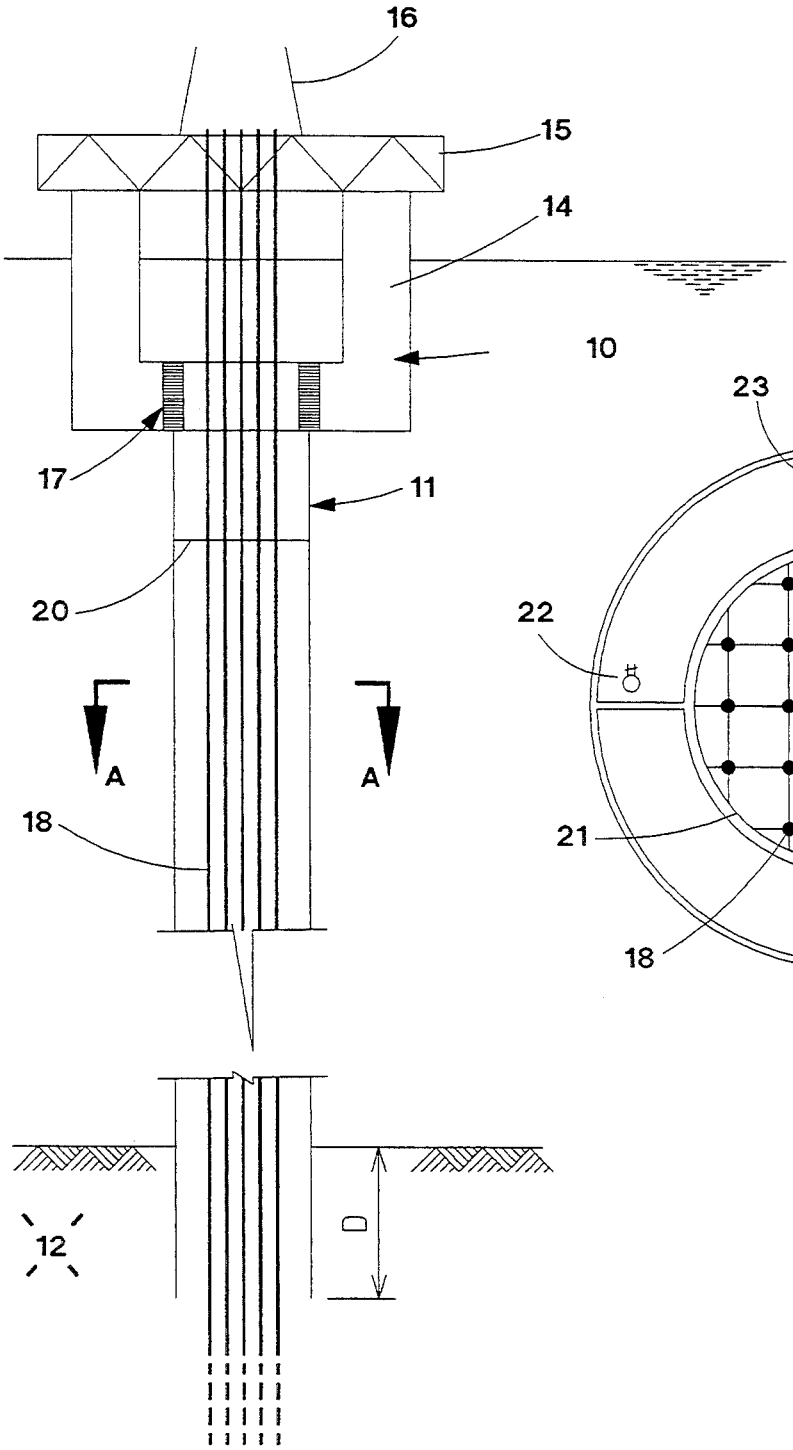
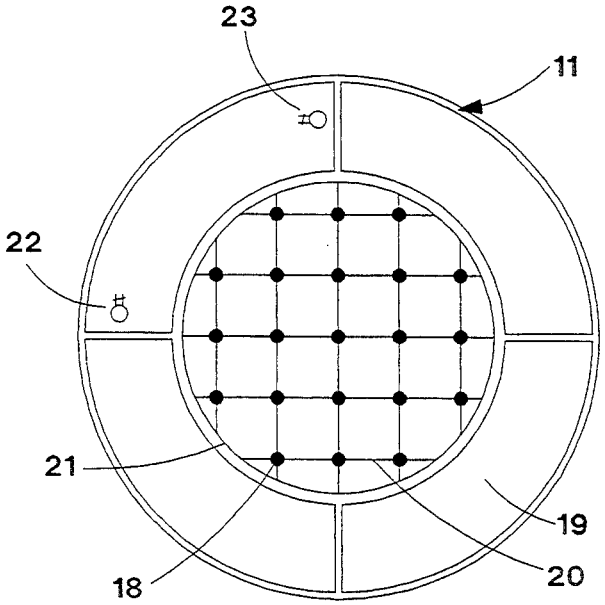
FIG 2

TENSION LEG PLATFORM

BACKGROUND OF THE INVENTION

The invention relates to a tension leg platform, and to a method of installing such a platform.

To provide stable platforms for the exploitation of subsea oil and gas reservoirs in deep water offshore, it is known to use fixed multi leg support structures. These support structures have been fixed in position by piles driven into the seabed, and typically have had drilling and production facilities in a deck assembly resting on top of the legs. The deck assembly has been supported on the piles by the legs acting in compression.

In increased water depths beyond say 1200 ft or 365 m (eg. 530 m for the Jolliet field in the Gulf of Mexico) fixed support structures based on piles with legs acting in compression are impractical. To provide a stable platform in these circumstances, the concept of a "Tension Leg Platform" has been developed. A tension leg platform for the Jolliet field was featured in OTC Papers 6359/60 presented at the 22nd OTC at Houston, Tex. in 1990.

The tension leg platform has a buoyant hull portion, held down against its own buoyancy by tethers arranged around its periphery. These tethers extend vertically downward to the seabed, where they are secured by piled or weighted anchor assemblies.

Known tension leg platform concepts have had groups of tethers arranged at each of three, four or six peripheral housings, and typically there may be three tethers at each of four corners. The complexity of such an arrangement, and the difficulties in devising economical inspection and maintenance procedures have led to a requirement for an alternative arrangement.

One particular tension leg platform concept, developed for a water depth of 4000 ft or 1220 m in the Gulf of Mexico, has been described as a single-leg tension-leg platform (STLP). This concept is outlined on pg 17 of the publication "Offshore" for July 1988. Each corner column has two spring buoy anchor lines to restrict lateral movements, and the tension leg beneath a central column is designed to resist heave motions alone. While this concept is referred to as a 'single leg' platform, it is clear that in fact the 'single leg' comprises six welded-body pipe tendons designed to resist tension and hydro static pressure.

Another tension leg platform concept is illustrated in FIG. 1A of UK Patent Specification 2250767A. This shows a monopod compliant platform in the form of a single column Tension Leg Well Jacket (TLWJ) with one or more tendons. In the single tendon embodiment, drilling and subsequently production risers (deployed from a separate semisubmersible vessel) are disposed around the outside of the single tendon. This configuration leaves the risers exposed to the hazards of ship impact.

SUMMARY OF THE INVENTION

In order to solve the problems associated with the prior art, it is proposed in accordance with the present invention to provide a tension leg platform for an oil rig that can be economically made, assembled, inspected and maintained, will provide protection for risers associated with the oil rig and will adequately support the oil rig even under severe weather conditions.

To accomplish these functions, the tension leg platform of the invention includes a deck, a buoyant hull and a single tubular tether. The tether has a lower end that penetrates into the seabed and an upper end that is secured to the hull to hold the hull down against its own buoyancy. The deck is secured to the hull and adapted to support an oil rig. Multiple casing strings extend through the tether from the deck to the seabed. Supplemental buoyancy tanks can be provided between the hull and the tether or within the tether itself. Such a tension leg platform is installed in accordance with the invention by first causing a lower end of the single tubular tether to penetrate into a seabed, floating the hull over a top end of the tubular tether, ballasting the hull down onto the top end of the tubular tether, securing the hull to the top end of the tubular tether and deballasting the hull to tension the tether.

By this arrangement, the risers will be protected from direct impacts from ships by being positioned within the tether. Utilising a single tether enables the platform to be more economically installed, inspected and maintained. Further, by properly ballasting the platform arrangement, the single tether can adequately support an oil rig even during severe weather conditions.

Further details, features and advantages of the present invention will become more readily apparent from the following detailed description of the preferred embodiments thereof when taken in conjunction with the drawings wherein like reference numeral refer to corresponding parts in the several views.

BRIEF DESCRIPTION OF THE DRAWINGS

Two specific embodiments of the invention will now be described by way of example with reference to the accompanying drawings, in which:

FIG. 1 is a schematic sectional view of a tension leg platform located in deep water;

FIG. 2 is a cross-section (to an enlarged scale) on the arrows AA in FIG. 1.

DETAILED DESCRIPTION OF THE PREFERRED EMBODIMENTS

Figure 3:
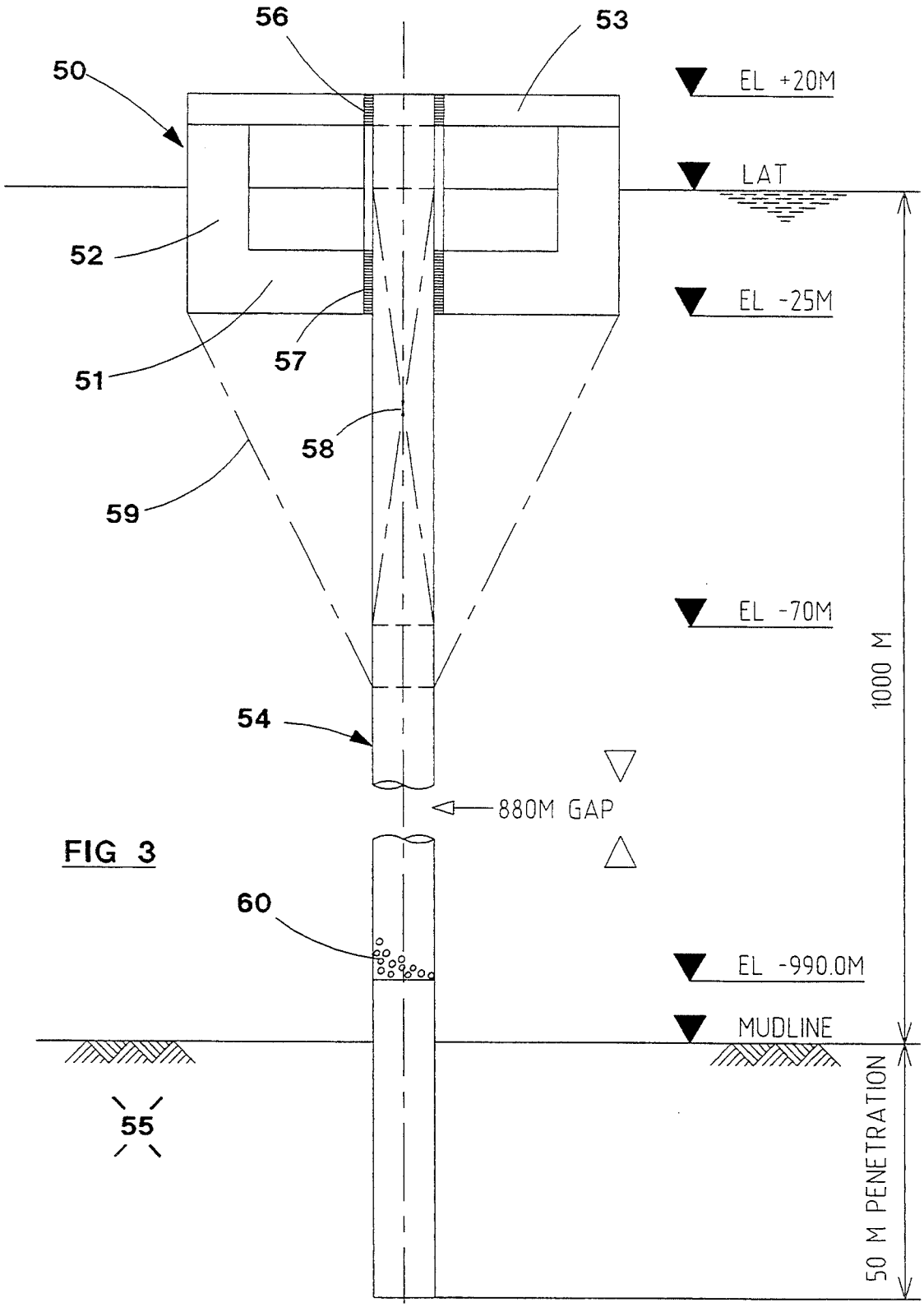
FIG. 3 is a sectional view of a second tension leg platform.

FIG. 1 shows a tension leg platform 10 connected by a single tubular tether 11 to the seabed 12. The tether 11 is a steel tube of circular cross section with an external diameter of 10 to 20 m.

The platform 10 comprises a hull 14, a deck 15 and a drilling rig 16. Within the lower part of the hull 14 there is a connection device 17, forming no part of this invention.

As shown in FIG. 2, the tether 11 houses twenty-one casing strings 18 for oil or gas wells which are therefore environmentally protected. The tether 11 has watertight compartments 19 to provide sufficient buoyancy for transportation and installation, and to create tension in the tether for the permanent situation. Flooding and emptying systems 22 and 23 are provided for selective ballasting.

Guides 20 may provide lateral support to the casing strings 18 if required, and may be attached to an inner tubular member 21 defining interior walls of the watertight compartments 19.

The tether 11 is installed by towing to site, assisted by the internal buoyancy of the watertight compartments 19. The tether is upended onto the seabed 12 by selective flooding of the compartments 19, and further flooding enables the tether to penetrate the seabed a distance D under self weight. The tether can also be preloaded to assist penetration into the seabed. Other methods of tether installation may be implemented, such as sectional assembly as the tether is lowered by one sectional length at a time.

The tension leg platform 10 is then floated over the tether 11 and ballasted down onto the top of the tether. The tether is mechanically connected to the device 17 in the hull. The hull of the tension leg platform is then deballasted to create tension in the tether.

The foregoing description refers to the schematic drawings of FIGS. 1 and 2. These illustrate the concept of the invention.

FIG. 3 shows a second specific embodiment of the invention, and this second embodiment will now be described giving indicative sizes and weights for one particular design of tether. For the purpose of illustration, it will be assumed that there is a requirement to place a 55,000 tons displacement TLP in a water depth of 1000 m with a pretensioning load of 5000 tons. It is assumed that the vessel will have an operating draft of 25 m, and will be subject to a 100 year storm wave of height 22 m. It is also assumed that the seabed stratum is composed of soft clay soils.

In this case the Tension Leg Platform (TLP) 50 has pontoons 51 and columns 52 (constituting a "hull" or vessel) and a deck 53. A single tubular tether 54 extends from the deck 53, through the pontoons 51, and thence vertically down to the seabed 55, and penetrates into the seabed for a distance of 50 m. The top of the tether 54 is secured to the deck 53 and pontoons 51 by upper and lower tether connectors 56 and 57 respectively, forming no part of this invention. The foot of the tether is securely located in the seabed against lateral movement by the resistance of the seabed strata.

The tether 54 consists of a steel tube of circular cross section with an outside diameter of 12.5 m and a wall thickness of 25 mm. At the foot of the tether (for the lowest 60 m of its length) the wall thickness is increased to 40 mm. The tether may have a horizontal watertight diaphragm near its foot, so that penetration into the seabed can be assisted by the weight of water above that diaphragm. The steel is of 450 Grade material with a yield stress of 430 $N/mm^2$, and the tether will satisfactorily resist a 100 year design storm without the steel being overstressed.

Within the tether there are twenty one vertical casing strings at 2.5 m well spacing supported by conductor guide steel work spaced apart at 50 m vertical intervals. Within the top 70 m of the tether below LAT there is a buoyancy tank 58. (It should be noted that this additional buoyancy could also be designed into the hull of the TLP).

The total steel weight for the tether would amount to some 7768 tons (25 mm wall thickness portion) and 737 tons (40 mm wall thickness portion), 400 tons for conductor guide steel work and say 1000 tons for the buoyancy tank 58 at the top end. This gives a total tether weight over its 1070 m length of nearly 10,000 tons, or a total weight in water of some 8600 tons. Given a permanent buoyancy of 8000 tons in the top of the tether and the requirement of a pretensioning load of 5000 tons, there would be a requirement for 4000 tons of ballast in the foot of the tether after ballasting the hull of the TLP, so to limit the tether foundation tension load.

The sizes and weights described above give a practical design of a tether for a TLP for the water depth and vessel displacement specified (ie. 1000 m depth and 55,000 tons displacement). This will resist static forces (and overturning moments) due to environmental loads from wind, waves and current during a design storm.

The design has been checked against in line vortex shedding, but might be subject to cross flow vibration in a design maximum current. The overall configuration might in certain circumstances be subject to overloads on the tether due to dynamic effects on the vessel. To avoid these problems it could be advantageous to cover the tether with an anti-fouling coating down to EL −120 m, and to provide guy lines 59 (shown chain dotted) for the tether from EL −80 m to the bottom external corners of the hull.

The tether 54 is installed by towing to site and upending, using a heavy lift vessel to provide support above sea level. The tether can be lowered by the HLV to penetrate 50 m into the seabed, and 4000 tons of ballast 60 can be added. Other methods of tether installation may be implemented, such as sectional assembly as the tether is lowered by one sectional length at a time.

The TLP 50 can then be floated over and fixed to the tether, and is finally deballasted to create tension in the tether. Casing strings (not shown) can then be run down the interior of the tether. Additionally, casing strings or risers can be tensioned and supported off the tether.

I claim:

1. A tension leg platform for supporting a drilling rig above a seabed comprising:

a buoyant hull portion;

a deck portion mounted atop said hull portion, said deck portion being adapted to support a drilling rig;

a single tubular tether having upper and lower, longitudinally spaced end portions, said upper end portion being secured to said hull portion and said lower end portion being adapted to extend into a seabed to a depth at which said single tubular tether secures the hull portion to the seabed and thereby supports said deck portion at a required location; and a plurality of casing strings extending within said single tubular tether from said deck portion to the seabed.

2. A tension leg platform as claimed in claim 1, further comprising a plurality of guides extending laterally, within said tubular tether, between said plurality of casing strings to support said plurality of casing strings within said tubular tether.

3. A tension leg platform as claimed in claim 1, further including a longitudinally extending tubular member concentrically located within said tubular tether.

4. A tension leg platform as claimed in claim 3, wherein said tubular tether is formed with a plurality of internal compartments, said internal compartments constituting buoyancy tanks.

5. A tension leg platform as claimed in claim 4, further including means for selectively flooding and emptying said buoyancy tanks.

6. A tension leg platform as claimed in claim 4, wherein said internal compartments are circumferentially spaced within said tubular tether between said tubular tether and said tubular member.

7. A tension leg platform as claimed in claim 1, further including a particulate solid ballast within the lower end portion of said tubular tether.

8. A tension leg platform as claimed in claim 1, further including a plurality of guy lines extending between said hull portion and said tubular tether, and connected to the tubular tether at points spaced vertically below the deepest part of the hull portion.

9. A method of installing a tension leg platform comprising:

causing a lower end of a single tubular tether to penetrate into a seabed to a depth sufficient to restrain the platform in order to assure that said platform will remain permanently at a predetermined site;

floating a hull over a top end of said tubular tether;

ballasting the hull down onto the top end of said tubular tether;

securing the hull to the top end of said tubular tether; and de-ballasting the hull to tension the tether.

* * * * *